US007797934B2

(12) United States Patent
Bacon et al.

(10) Patent No.: US 7,797,934 B2
(45) Date of Patent: Sep. 21, 2010

(54) ANTI-STALL SYSTEM UTILIZING IMPLEMENT PILOT RELIEF

(75) Inventors: Kevin A. Bacon, Leicester (GB); Andrew J. Smith, Ashbourne (GB)

(73) Assignee: Caterpillar Inc, Peoria, IL (US)

( * ) Notice: Subject to any disclaimer, the term of this patent is extended or adjusted under 35 U.S.C. 154(b) by 491 days.

(21) Appl. No.: 11/797,017

(22) Filed: Apr. 30, 2007

(65) Prior Publication Data

US 2008/0264499 A1 Oct. 30, 2008

(51) Int. Cl.
*E02F 9/22* (2006.01)
*F15B 11/05* (2006.01)

(52) U.S. Cl. ..... 60/431; 60/449

(58) Field of Classification Search ..... 60/420, 60/422, 431, 449, 452
See application file for complete search history.

(56) References Cited

U.S. PATENT DOCUMENTS 6,220,028 B1 4/2001 Ishikawa et al.
6,305,419 B1 * 10/2001 Krieger et al. ..... 60/431
6,644,025 B1 * 11/2003 Oberhausser et al. ..... 60/422
6,666,023 B2 12/2003 Nagura et al.
7,165,397 B2 1/2007 Raszga et al.
2002/0083825 A1 7/2002 Kusuyama
2005/0160904 A1 7/2005 Raszga et al.
2007/0016349 A1 1/2007 Oka

FOREIGN PATENT DOCUMENTS

EP 0 765 970 B1 4/1997

* cited by examiner

*Primary Examiner*—Thomas E Lazo
(74) *Attorney, Agent, or Firm*—Finnegan, Henderson, Farabow, Garrett & Dunner LLC

(57) ABSTRACT

A hydraulic control system for a machine is disclosed. The hydraulic control system may have a source driven by an engine to pressurize fluid, and a tool actuator movable by pressurized fluid. The hydraulic control system may further have a first valve element movable to control an amount of pressurized fluid directed to the tool actuator, and an interface device movable by an operator to control an amount of pressurized fluid directed to move the first valve element. The hydraulic control system may also have a second valve element movable to limit an amount of pressurized fluid available to move the first valve element, and a controller in communication with the second valve element. The controller may be configured to move the second valve element to reduce pressurized fluid directed to the first valve element in an amount related to a load on the engine.

25 Claims, 2 Drawing Sheets

ANTI-STALL SYSTEM UTILIZING IMPLEMENT PILOT RELIEF

TECHNICAL FIELD

The present disclosure relates generally to an anti-stall control system for a construction machine, and more particularly, to an anti-stall system that utilizes implement pilot relief.

BACKGROUND

Machines such as, for example, loaders, excavators, dozers, motor graders, and other types of heavy equipment use multiple actuators supplied with hydraulic fluid from an engine-driven pump to accomplish a variety of tasks. These actuators are typically pilot controlled such that, as an operator moves an input device, for example a joystick, an amount of pilot fluid is directed to a control valve to move the control valve. As the control valve is moved, a proportional amount of fluid is directed from the pump to the actuators. For cost and efficiency reasons, the machine's engine may be too small to drive the pump and supply a maximum amount of pressurized fluid that could be demanded by an operator at any given time. Thus, it may be possible for the operator's demands, if fully satisfied, to stall the machine's engine under some conditions. That is, the amount of power required from the engine to drive the pump, as demanded by the operator, may exceed an output capacity of the engine, thereby causing the engine to stall.

One method of selectively reducing the load on an engine under stall conditions is described in U.S. Pat. No. 7,165,397 (the '397 patent) issued to Raszga et al. on Jan. 23, 2007. The '397 patent describes a hydraulic control system that automatically reduces or eliminates the hydraulic load on an engine in response to the capacity of the engine being overcome by the hydraulic load. Specifically, the hydraulic control system includes a pilot supply circuit, which supplies pressurized pilot fluid to a plurality of implement joysticks. An anti-stall valve is located within the pilot supply circuit to selectively block the supply of pressurized pilot fluid from the joysticks. The pilot supply circuit applies a pressure differential to opposite sides of the anti-stall valve dependent on engine speed. As engine speed reduces toward stall conditions, the pressure differential correspondingly reduces and blocks pilot fluid flow to the implement joysticks. When the pressure differential falls below a certain value, the pilot flow is turned off and remains off until engine speed recovers. In addition, movement of the anti-stall valve also relieves pilot fluid pressure in communication with the implement joysticks to a low pressure drain. The hydraulic control system thereby provides quick, smooth, and potentially total removal of hydraulic load on the engine, while holding the positions of the hydraulic functions when engine speed drops. This enables a machine designer to select an engine size that will be efficient for most operations, without concerns for occasional different or combined operations that produce engine speed decreases and stalls.

Although the hydraulic control system of the '397 patent may reduce the likelihood of stalling an engine due to hydraulic overloading, its usefulness may be limited. Specifically, because the anti-stall valve only turns the pilot fluid off and holds the positions of the hydraulic functions, there may be situations where hydraulic operation is completely halted when only a reduction in operation was necessary. In addition, there may be conditions where adjustments to the anti-stall operation may be beneficial, such as when the operator desires to run the engine at less than full speed. Under these conditions, the hydraulic control system of the '397 patent must simply be rendered non-operational by way of an override valve.

The disclosed control system is directed to overcoming one or more of the problems set forth above.

SUMMARY OF THE DISCLOSURE

In one aspect, the present disclosure is directed to a hydraulic control system. The hydraulic control system may include a source driven by an engine to pressurize fluid, and a tool actuator movable by pressurized fluid. The hydraulic control system may further include a first valve element movable to control an amount of pressurized fluid directed to the tool actuator, and an interface device movable by an operator to control an amount of pressurized fluid directed to move the first valve element. The hydraulic control system may also include a second valve element movable to limit an amount of pressurized fluid available to move the first valve element, and a controller in communication with the second valve element. The controller may be configured to move the second valve element to reduce pressurized fluid directed to the first valve element in an amount related to a load on the engine.

In another aspect, the present disclosure is directed to a method of preventing engine stall. The method may include pressurizing actuator fluid at a variable rate, and directing the actuator fluid to move a tool. The method may further include directing pilot fluid to regulate a flow of the actuator fluid to the tool. The method may also include determining a parameter of an engine indicative of stall, and limiting a flow of the pilot fluid to an amount relating to a value of the parameter to reduce a rate of the pressurizing.

DETAILED DESCRIPTION

Figure 1:
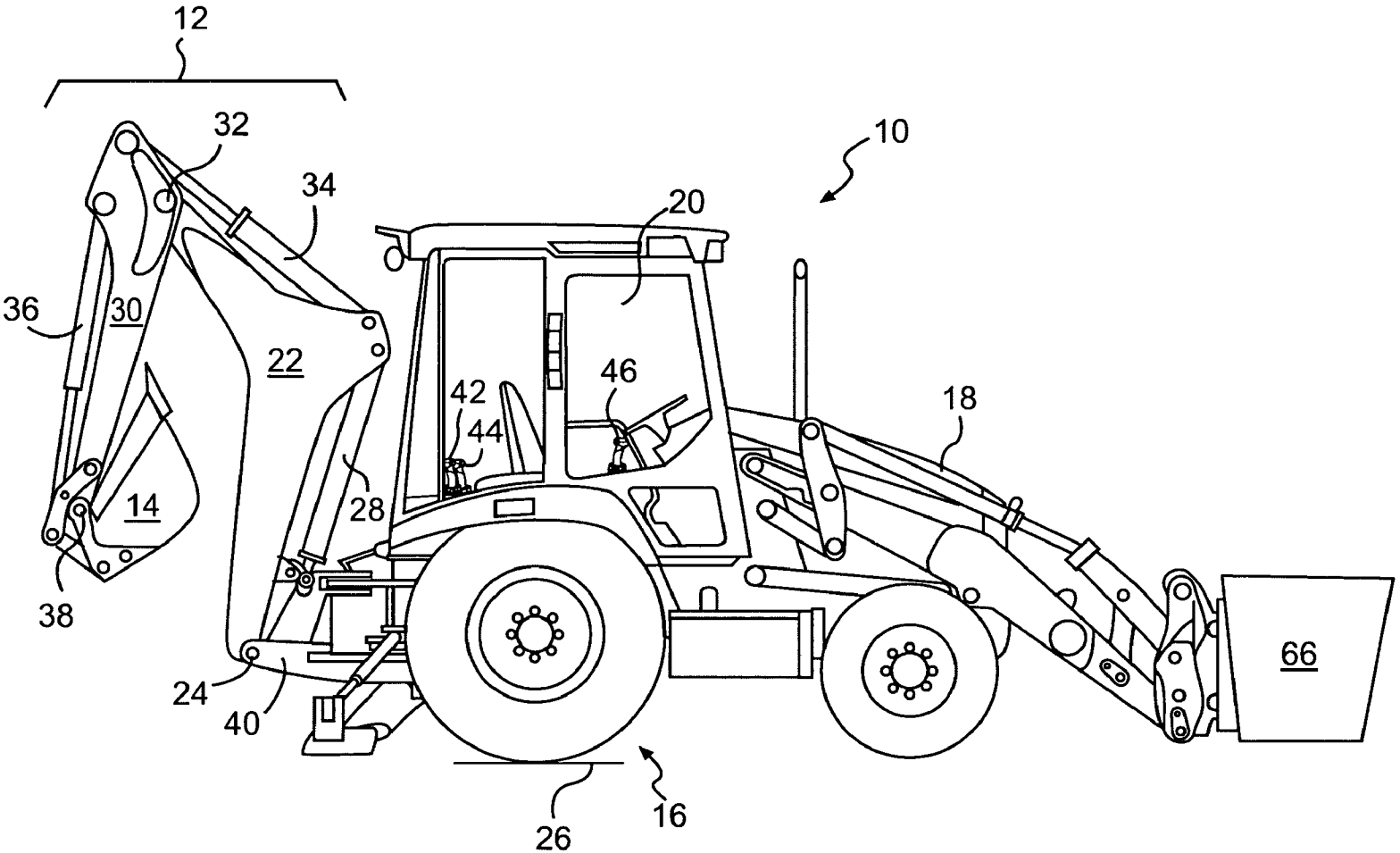
FIG. 1 is a side-view diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or any other industry known in the art. For example, machine 10 may be an earth moving machine such as a backhoe, an excavator, a dozer, a loader, a motor grader, a dump truck, or any other earth moving machine. Machine 10 may include an implement system 12 configured to move a work tool 14, a drive system 16 for propelling machine 10, a power source 18 that provides power to implement system 12 and drive system 16, and an operator station 20 for operator control of implement and drive systems 12, 16.

Implement system 12 may include a linkage structure acted on by fluid actuators to move work tool 14. Specifically, implement system 12 may include a boom member 22 vertically pivotal about a pivot axis 24 relative to a work surface 26 by a single, double-acting, hydraulic cylinder 28. Implement system 12 may also include a stick member 30 vertically pivotal about a pivot axis 32 by a single, double-acting, hydraulic cylinder 34. Implement system 12 may further include a single, double-acting, hydraulic cylinder 36 operatively connected to work tool 14 to pivot work tool 14 vertically about a pivot axis 38. Boom member 22 may be pivotally connected to a frame 40 of machine 10. Stick member 30 may pivotally connect boom member 22 to work tool 14 by way of pivot axis 32 and 38.

Each of hydraulic cylinders 28, 34, 36 may include a tube and a piston assembly (not shown) arranged to form two separated pressure chambers. The pressure chambers may be selectively supplied with pressurized fluid and drained of the pressurized fluid to cause the piston assembly to displace within the tube, thereby changing the effective length of hydraulic cylinders 28, 34, 36. The flow rate of fluid into and out of the pressure chambers may relate to a velocity of hydraulic cylinders 28, 34, 36, while a pressure differential between the two pressure chambers may relate to a force imparted by hydraulic cylinders 28, 34, 36 on the associated linkage members. The expansion and retraction of hydraulic cylinders 28, 34, 36 may function to assist in moving work tool 14.

Numerous different work tools 14 may be attachable to a single machine 10 and controllable via operator station 20. Work tool 14 may include any device used to perform a particular task such as, for example, a bucket, a fork arrangement, a blade, a shovel, a ripper, a dump bed, a broom, a snow blower, a cutting device, a grasping device, or any other task-performing device known in the art. Although connected in the embodiment of FIG. 1 to pivot relative to machine 10, work tool 14 may alternatively or additionally rotate, slide, swing, lift, or move in any other manner known in the art.

Power source 18 may embody an engine such as, for example, a diesel engine, a gasoline engine, a gaseous fuel-powered engine or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic power for moving hydraulic cylinders 28, 34, 36.

Figure 2:
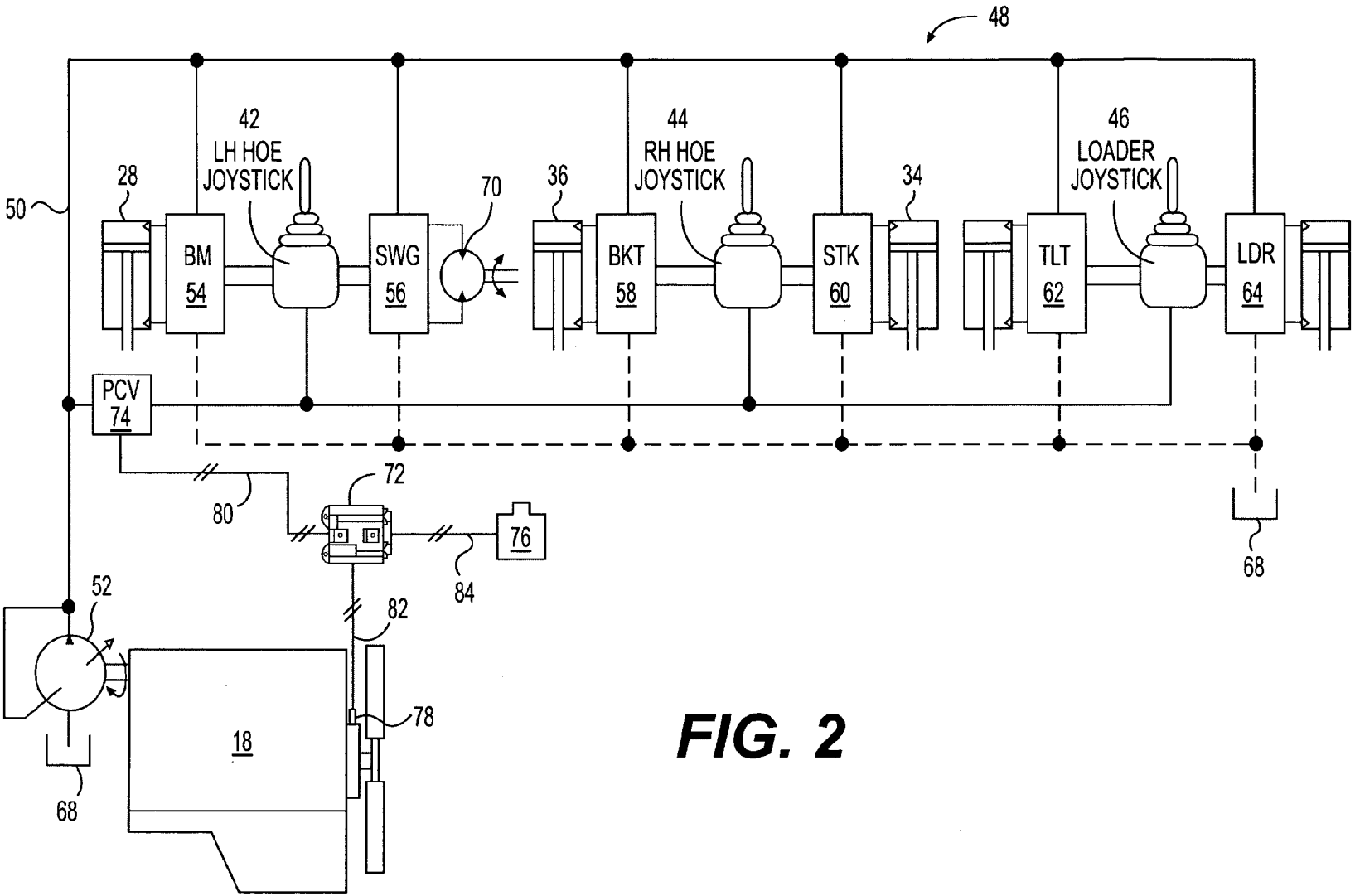
FIG. 2 is a schematic illustration of an exemplary disclosed hydraulic control system for use with the machine of FIG. 1.

A sensor 78 (as shown in FIG. 2) may be associated with power source 18 to sense a parameter indicative of stall. For example, sensor 78 may be an engine speed sensor configured to generate a signal that corresponds to rotational speed of the engine. Alternatively, sensor 78 may be any other type of sensor sufficient to sense engine load, including by way of example, a torque sensor or a fluid flow sensor.

Operator station 20 may receive input from a machine operator indicative of a desired work tool and/or machine movement. Specifically, operator station 20 may include one or more operator interface devices embodied as single or multi-axis joysticks located proximal an operator seat. The operator interface devices may include, among other things, a left hand hoe joystick 42, a right hand hoe joystick 44, and a loader joystick 46. Operator interface devices 42-46 may be proportional-type controllers configured to position and/or orient work tool 14 by varying fluid pressure to hydraulic cylinders 28, 34, and 36. Likewise, the same or other operator interface devices 42-46 may be configured to position and/or orient machine 10 relative to work surface 26 by varying fluid pressure to position actuators. It is contemplated that different operator interface devices may alternatively or additionally be included within operator station 20 such as, for example, wheels, knobs, push-pull devices, switches, pedals, and other operator interface devices known in the art.

As illustrated in FIG. 2, machine 10 may include a hydraulic control system 48 having a plurality of fluid components that cooperate to move work tool 14 (referring to FIG. 1). In particular, hydraulic control system 48 may include a circuit 50 configured to receive a first stream of pressurized fluid from a source 52. Circuit 50 may include a boom control valve 54 and a swing control valve 56 connected to receive pressurized fluid in parallel and controlled by left hand hoe joystick 42. Circuit 50 may also include a bucket control valve 58 and a stick control valve 60 connected to receive pressurized fluid in parallel and controlled by right hand hoe joystick 44. It is contemplated that additional actuator control valve mechanisms may be included within circuit 50, such as, for example, a tilt control valve 62 and a loader control valve 64 configured to control a second work tool 66 (as shown in FIG. 1) by way of loader joystick 46.

Source 52 may draw fluid from one or more tanks 68 and pressurize the fluid to predetermined levels. Specifically, source 52 may embody a pumping mechanism such as, for example, a variable displacement pump, a fixed displacement pump, or any other source known in the art. Source 52 may include a single pump that supplies pressurized actuator and pilot fluid to both the hydraulic cylinders 28, 34, 36 and the operator interface devices 42-46, respectively. Source 52 may be load sensing and have variable displacement, and a reduction in the amount of pressurized fluid consumed by the hydraulic cylinders 28, 34, 36 may result in a reduction in the displacement of the source 52. Source 52 may be drivably connected to power source 18 of machine 10 by, for example, a countershaft, a belt (not shown), an electrical circuit (not shown), or in any other suitable manner. Alternatively, source 52 may be indirectly connected to power source 18 via a torque converter, a reduction gear box, or in any other suitable manner. Further, source 52 may alternatively include separate pumping mechanisms to independently supply actuator fluid to the hydraulic cylinders 28, 34, 36 and pilot fluid to the operator interface devices 42-46.

Tank 68 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 68. It is contemplated that hydraulic control system 48 may be connected to multiple separate fluid tanks or to a single tank.

Each of boom, swing, bucket, stick, tilt and loader control valves 54-64 may regulate the motion of their related fluid actuators. Specifically, boom control valve 54 may have elements movable to control the motion of hydraulic cylinder 28 associated with boom member 22, swing control valve 56 may have elements movable to control swing motor 70 associated with providing rotational movement of implement system 12, bucket control valve 58 may have elements movable to control the motion of hydraulic cylinder 36 associated with work tool 14, and stick control valve 60 may have elements movable to control the motion of hydraulic cylinder 34 associated with stick member 30. Likewise, tilt control valve 62 and loader control valve 64 may each have valve elements movable to control the motion of second work tool 66. It is contemplated that a pair of double acting cylinders may be used as an alternative to swing motor 70 to provide rotational movement of implement system 12 and that a motor may be used as an alternative to each hydraulic cylinder 28, 34, 36 to provide movement to the boom member 22, stick member 30, and work tool 14, respectively.

Because the elements of boom, bucket, swing, bucket, stick, tilt, and loader control valves 54-64 may be similar and function in a related manner, only the operation of boom control valve 54 will be discussed in this disclosure. In one example, boom control valve 54 may include a first chamber supply element (not shown), a first chamber drain element (not shown), a second chamber supply element (not shown), and a second chamber drain element (not shown). The first and second chamber supply elements may be connected in parallel to receive actuation fluid from circuit 50 to fill their respective chambers with fluid pressurized by source 52, while the first and second chamber drain elements may be connected in parallel with tank 68 to drain the respective chambers of fluid. To extend hydraulic cylinder 28, the first chamber supply element may be moved to allow the pressurized fluid from source 52 to fill the first chamber of hydraulic cylinder 28 with pressurized fluid, while the second chamber drain element may be moved to drain fluid from the second chamber of hydraulic cylinder 28 to tank 68. To move hydraulic cylinder 28 in the opposite direction, the second chamber supply element may be moved to fill the second chamber of hydraulic cylinder 28 with pressurized fluid, while the first chamber drain element may be moved to drain fluid from the first chamber of hydraulic cylinder 28. It is contemplated that both the supply and drain functions may alternatively be performed by a single element associated with the first chamber and a single element associated with the second chamber.

The supply and drain elements of boom control valve 54 may be pilot operated. Specifically, each of the supply and drain elements may embody spools movable by pressurized pilot fluid to open and close, thereby establishing the fluid connections described above. The pressurized pilot fluid may be directed to move the supply and drain elements in response to movements of the associated operator input device. For example, as left hand joystick 42 is pushed forward (i.e., away from the operator), pressurized pilot fluid may be directed to move the appropriate supply and drain elements of boom control valve 54 to extend hydraulic cylinder 28, thereby moving boom member 22 down toward work surface 26. Similarly, as left hand joystick 42 is pull backward (i.e., toward the operator), pressurized pilot fluid may be directed to move the appropriate supply and drain elements of boom control valve 54 to retract hydraulic cylinder 28, thereby moving boom member 22 upward away from work surface 26.

A proportional control valve 74 may be situated within circuit 50 to regulate the flow of pressurized fluid available to operator interface devices 42-46. Proportional control valve 74 may be an electronically actuated proportional type valve located between source 52 and operator interface devices 42-46. In response to a command signal, proportional control valve 74 may proportionally restrict a flow rate of the pilot fluid to operator interface devices 42-46. In this manner, for a given movement of operator interface devices 42-46, less movement of the supply and drain elements of the corresponding actuator control valves 54-64 may be affected. Thus, by selectively restricting the flow of pilot fluid available to operator interface devices 42-46, the amount of actuation fluid directed to and consumed by hydraulic actuators 28, 34, 36, and 70 may be limited.

Controller 72 may command proportional control valve 74 to restrict the flow of pressurized pilot fluid directed to the operator interface devices 42-46 in an amount related to a load on the power source 18, as monitored by sensor 78. Controller 72 may be in communication with proportional control valve 74 and sensor 78 by communication lines 80 and 82 respectively. Specifically, as the signal from sensor 78 indicates a load on power source 18 that may result in stall, controller 72 may command proportional control valve 74 to restrict the flow of pressurized pilot fluid to operator interface devices 42-46. The command restriction may be related to the load on power source 18 and/or the likelihood of power source 18 stalling under the sensed load.

It is contemplated that controller 72 may command proportional control valve 74 to restrict the flow of pilot fluid to operator interface devices 42-46 even when the likelihood of stall is low. Specifically, controller 72 may command proportional control valve 74 to restrict the flow of pilot fluid in response to a manual selection of a machine operational mode. That is, machine 10 may operate under a course or normal control mode and a fine control mode. When under the course control mode, the flow of pressurized pilot fluid to operator interface devices 42-46 may be substantially unrestricted. However, when under the fine control mode, the flow of pressurized pilot fluid to operator interface devices 42-46 may be restricted to a discrete predetermined amount or to an amount selected by an operator such that less work tool movement is effected for a given amount of operator interface device 42-46 movement. While in the fine mode, an operator of machine 10 may have more precise control over the movement of work tool 14. The selection of operational modes may be made by way of a operator mode selector switch 76. Controller 72 may be in communication with operator mode selector switch 76 by communication line 84.

INDUSTRIAL APPLICABILITY

The disclosed hydraulic control system may be applicable to any machine that includes fluid actuators where reducing the likelihood and/or severity of engine stall is desired. The disclosed hydraulic control system may reduce engine stall by sensing a near stall condition and proportionally reducing the flow of pilot fluid available to operator interface devices 42-46 of the machine 10. The reduced pilot fluid flow may limit a maximum amount of hydraulic load an operator can demand, thereby indirectly reducing engine load and minimizing the likelihood of engine stall. In addition, by limiting the maximum load an operator can demand for a given amount of operator interface device 42-46 movement during a non-stall condition, operator control of the machine 10 may be enhanced. The operation of hydraulic control system 48 will now be explained.

A typical hydraulic system may be pilot controlled by way of pilot fluid pressure being supplied to control valves in response to an operator's input. For example, as an operator pushes operator interface device 42, 44, or 46 to its fullest extent in one direction, pilot fluid my be supplied at a maximum flow rate and/or pressure to actuator control valves 54, 56, 58, 60, 62, and/or 64, thereby moving a spool or other element within the respective actuator control valve to its maximum position. In this maximum spool position, a maximum amount of actuation fluid from source 52 may be supplied to the respective implement. As operator interface device 42, 44, or 46 is returned to a neutral position from the maximum displaced position, the pilot fluid flow rate and/or pressure supplied to actuator control valves 54, 56, 58, 60, 62, and/or 64 may be reduced, thereby allowing the spool to also return to a neutral or flow blocking position.

In this system, when the maximum flow rate and/or pressure of the pilot fluid available to operator interface devices 42-46 is limited based on detected stall conditions of power source 18, the maximum displacement of the spool in the actuator control valves 54-64 may also limited. By limiting the maximum displacement position of the spool in the actuator control valves 54-64, the amount of actuation fluid supplied by the source 52 to the respective actuators may also be limited. By reducing demand on the source 52, less power may be required of power source 18, thereby reducing the likelihood of engine stall. A reduction in the amount and/or pressure of pilot fluid available to the operator interface devices 42-46 may result in a reduction in the amount of pressurized actuation fluid directed to the hydraulic cylinders 28, 34, 36, which may further result in a power absorption reduction of source 52. It is contemplated that at least some pressurized pilot fluid is always available to the operator interface devices 42-46, such that some movement of work tool 14 may always be possible. Furthermore, the flow rate and/or pressure of pilot fluid available to the operator interface devices 42-46 may be limited to only when a load of power source 18 exceeds a predetermined load or deviates from an expected range that may be monitored by sensor 78.

There may be situations when an operator desires to selectively choose an operational mode that limits pilot fluid flow and/or pressure. For example, the operator may select a desired mode by utilizing the operator mode selector switch 76, regardless of sensor 78 detecting an engine load indicative of a non-stall condition. That is, the maximum pilot flow rate and/or pressure available to operator interface devices 42-46 may be reduced even when there is no danger of stalling, to increase operator control of work tool 14. The additional operator initiated modes may include the fine control mode of operation and the course control mode of operation. For example, when the maximum flow rate and/or pressure of the pilot fluid is reduced, the operator may still move an operator interface device 42, 44, or 46 to its fullest extent, but only effect a relatively small movement of the work tool 14 because the flow of actuation fluid to work tool 14 may be reduced. This increased control over the tool's movement may be beneficial when accomplishing tasks requiring high accuracy or precision such as during final grading or moving delicate items.

During a detected stall condition by sensor 78, controller 72 may proportionally control the pilot fluid flow rate and/or pressure to reduce engine load without completely inhibiting the working tool movement, thereby increasing operational control. It may be desirable to have some control over the implement at all times, even a relatively reduced amount of control, during operation of the working machine 10 to allow the operator uninterrupted use of work tool 14 and thereby increase productivity and operational safety.

Furthermore, operational control may be improved by allowing multiple modes of operation, whereby direct operator control of the pilot pressure fluid may be selected independent of a sensed stall condition. Multiple mode selection may provide the operator with varying levels of control during operation such that an operator may quickly and efficiently move the implement during rough operational tasks or the operator may slowly and accurately move the implement during fine operational tasks.

It will be apparent to those skilled in the art that various modifications and variations can be made to the disclosed hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic tool control system, comprising:

a source driven by an engine to pressurize fluid;

a plurality of tool actuators movable by pressurized fluid from the source;

a plurality of first valve elements movable to control an amount of pressurized fluid directed to the plurality of tool actuators;

at least one interface device movable by an operator to control an amount of pressurized fluid directed to move the plurality of first valve elements;

a second valve element movable to limit an amount of pressurized fluid flow available to move the plurality of first valve elements; and a controller in communication with the second valve element and during a first mode of operation being configured to move the second valve element to reduce pressurized fluid flow directed to the plurality of first valve elements only during a stall or near stall condition in an amount related to the stall condition of the engine caused by operation of the plurality of tool actuators.

2. The hydraulic tool control system of claim 1, wherein second valve element is located between the source and the at least one interface device.

3. The hydraulic tool control system of claim 1, wherein the controller moves the second valve element to reduce the amount of pressurized fluid flow directed to the at least one interface device only when the load on the engine exceeds a predetermined load.

4. The hydraulic tool control system of claim 3, further including a sensor configured to generate a signal indicative of the load on the engine and to provide the signal to the controller.

5. The hydraulic tool control system of claim 1, wherein the second valve element is an electronically actuated proportional control valve.

6. The hydraulic tool control system of claim 1, wherein at least some of the pressurized fluid flow is always available to the at least one interface device.

7. The hydraulic tool control system of claim 1, wherein the source includes a single pump that supplies pressurized fluid flow to both the plurality of tool actuators and the at least one interface device.

8. The hydraulic tool control system of claim 1, wherein a reduction in the amount of pressurized fluid flow directed to the plurality of first valve elements results in a reduction in the amount of pressurized fluid flow directed to the plurality of tool actuators.

9. The hydraulic tool control system of claim 8, wherein the reduction in the amount of pressurized fluid flow directed to the plurality of tool actuators results in a torque absorption reduction of the source.

10. The hydraulic tool control system of claim 9, wherein the source is load sensing and variable displacement, and a reduction in the amount of pressurized fluid flow directed to the plurality of tool actuators results in a reduction in the displacement of the source.

11. The hydraulic tool control system of claim 1, further including a mode switch configured to generate a signal indicative of an operator-desired one of two modes of pilot operation, wherein the controller is further configured to selectively move the second valve element to modify pressurized fluid flow directed to the plurality of first valve elements independent of the stall condition of the engine based on a position of the mode switch.

12. The hydraulic tool control system of claim 1, wherein the plurality of tool actuators includes two or more of a boom cylinder, a swing motor, a bucket cylinder, a stick cylinder, a tilt cylinder, and a loader cylinder.

13. A method of preventing engine stall, comprising:

pressurizing actuator fluid at a variable rate;

directing the actuator fluid to move a plurality of tool actuators;

directing pilot fluid to regulate a flow of the actuator fluid to the plurality of tool actuators;

sensing a parameter of an engine stall condition caused by the plurality of tool actuators; and during a first mode of operation, limiting a flow of the pilot fluid to an amount corresponding to a value of the parameter to reduce a rate of the pressurizing only during a stall or near stall condition.

14. The method of claim 13, wherein the limiting includes limiting only when a value of the parameter deviates from an expected range.

15. The method of claim 13, further including always maintaining a minimum flow of pilot fluid.

16. The method of claim 13, wherein the limiting results in a reduction of a load on the engine.

17. The method of claim 13, wherein the pressurizing of actuator fluid includes pressurizing actuator fluid and pilot fluid with a single common source.

18. The method of claim 13, further including:

receiving an input indicative of an operator-desired selection of two modes of pilot operation; and modifying the flow rate of pilot fluid based on the input independent of the value of the parameter.

19. A machine, comprising:

an engine;

a drive system driven by the engine to propel the machine;

a hydraulic tool control system separate from the drive system and including:

a plurality of work tools;

a plurality of tool actuators configured to move the plurality of work tools;

a pump driven by the engine to pressurize fluid;

a plurality of first valve elements movable to control an amount of pressurized fluid flow directed from the pump to the plurality of tool actuators;

at least one interface device movable by an operator to control an amount of pressurized fluid flow directed from the pump to move the plurality of first valve element elements;

a second valve element movable to control an amount of pressurized fluid flow available to move the plurality of first valve elements;

a sensor associated with the engine to generate a signal indicative of an engine stall condition caused by the plurality of tool actuators; and a controller in communication with the second valve element and the sensor, the controller being configured to move the second valve element to reduce pressurized fluid flow directed to the first valve element in an amount related to the value of the signal, wherein the controller moves the second valve element during a first mode of operation to reduce the amount of pressurized fluid flow directed to the first valve element only when the value indicates the load on the engine exceeds a predetermined load.

20. The machine of claim 19, wherein:

the sensor is an engine speed sensor and the signal corresponds to a rotational speed of the engine; and the second valve element is an electronically actuated proportional control valve.

21. The machine of claim 19, wherein at least some of the pressurized fluid flow is always available to the at least one interface device.

22. The machine of claim 19, wherein a reduction in the amount of pressurized fluid flow directed to the at least one interface device results in a reduction in the amount of pressurized fluid flow directed to the plurality of tool actuators.

23. The machine of claim 22, wherein:

the pump includes a single pump that supplies pressurized fluid to the plurality of tool actuators and the at least one interface device;

the single pump is load sensing and variable displacement; and a reduction in the amount of pressurized fluid flow directed to the hydraulic actuator results in a reduction in the displacement of the single pump.

24. The machine of claim 19, wherein the hydraulic tool control system further includes a mode switch configured to generate a signal indicative of an operator-desired one of two modes of pilot operation, and the controller is further configured to selectively move the second valve element to modify pressurized fluid flow directed to the plurality of first valve elements independent of the engine stall condition based on a position of the mode switch.

25. The machine of claim 19, wherein the plurality of tool actuators includes two or more of a boom cylinder, a swing motor, a bucket cylinder, a stick cylinder, a tilt cylinder, and a loader cylinder.

* * * * *